US011352782B2

(12) United States Patent
Amend

(10) Patent No.: US 11,352,782 B2
(45) Date of Patent: Jun. 7, 2022

(54) SOIL GAS BARRIER SYSTEM, AND VENTILATION PANEL FOR SAME

(71) Applicant: Victor Amend, Toronto (CA)

(72) Inventor: Victor Amend, Toronto (CA)

( * ) Notice: Subject to any disclaimer, the term of this patent is extended or adjusted under 35 U.S.C. 154(b) by 0 days.

(21) Appl. No.: 16/656,872

(22) Filed: Oct. 18, 2019

(65) Prior Publication Data

US 2021/0115660 A1 Apr. 22, 2021

(51) Int. Cl.

| | |
|---|---|
| ***E04B 5/00*** | (2006.01) |
| ***E04B 1/62*** | (2006.01) |
| ***F24F 7/10*** | (2006.01) |
| ***E04B 2/00*** | (2006.01) |

(52) U.S. Cl.
CPC ..... *E04B 1/62* (2013.01); *E04C 2/44* (2013.01); *F24F 7/10* (2013.01)

(58) Field of Classification Search
CPC ..... F24F 7/10
See application file for complete search history.

(56) References Cited

U.S. PATENT DOCUMENTS

| | | | | |
|---|---|---|---|---|
| 2,961,030 A * | 11/1960 | Barrett | E04B 1/62 | 156/145 |
| 3,424,647 A * | 1/1969 | O'Connor | E04D 5/10 | 442/324 |
| 3,482,505 A * | 12/1969 | Dobbins | F24F 7/10 | 454/296 |
| 5,733,824 A * | 3/1998 | Brunka | B32B 5/26 | 442/153 |
| 7,181,888 B1 * | 2/2007 | Facaros | E02D 31/02 | 52/169.5 |
| 7,386,957 B2 * | 6/2008 | Duffney | B08B 15/02 | 52/169.5 |
| 8,007,205 B2 * | 8/2011 | Marshall, III | B32B 27/12 | 405/229 |
| 2008/0041004 A1 * | 2/2008 | Gibbar | E04C 2/288 | 52/309.12 |
| 2011/0197543 A1 * | 8/2011 | Lee | B32B 27/08 | 52/745.05 |
| 2011/0283641 A1 * | 11/2011 | Aubut | E02D 31/008 | 52/302.1 |
| 2013/0227904 A1 * | 9/2013 | Amend | E04F 15/185 | 52/309.11 |

(Continued)

FOREIGN PATENT DOCUMENTS

| | | |
|---|---|---|
| GB | 2261002 | 5/1993 |

OTHER PUBLICATIONS

Finnfoam Insulation Boards Finnfoam Oy; RT K-36028en / RT 375.2-36028en; Jan. 2001.

(Continued)

*Primary Examiner* — Basil S Katcheves
(74) *Attorney, Agent, or Firm* — Renner, Kenner, Greive, Bobak, Taylor & Weber

(57) ABSTRACT

A ventilation panel for a soil gas barrier system includes: an insulating foam body having first and second opposing faces and a plurality of grooves to define, in cross-section, an interconnected plurality of ventilation channels having walls that extend into the ventilation panel from the second face toward the first face; and a film of substantially gas-impervious material attached to at least one of the first face and the second face.

20 Claims, 14 Drawing Sheets

(56) References Cited

U.S. PATENT DOCUMENTS

| | | | | |
|---|---|---|---|---|
| 2014/0014255 | A1* | 1/2014 | Amend | E04F 15/185<br>156/78 |
| 2015/0096249 | A1* | 4/2015 | Amend | E04C 2/04<br>52/309.13 |
| 2015/0135634 | A1* | 5/2015 | Hoie | B29C 44/3461<br>52/741.4 |
| 2015/0376895 | A1* | 12/2015 | Fox | F24F 7/00<br>52/302.3 |
| 2020/0088425 | A1* | 3/2020 | Teoh | F24F 5/0035 |

OTHER PUBLICATIONS

RADON; Guidance on protective measures for new buildings; Christ Scivyer; 2007 edition; BR 211 © Copyright BRE 2007; First published 1991; ISBN 978-1-84806-013-5.

* cited by examiner

SOIL GAS BARRIER SYSTEM, AND VENTILATION PANEL FOR SAME

FIELD OF THE INVENTION

The following is directed in general to building construction, and more particularly to a soil gas barrier system and a ventilation panel for same.

BACKGROUND OF THE INVENTION

In the field of building and construction, measures are increasingly being used in newly-constructed residential and commercial buildings to reduce or eliminate the flow of soil gas, such as radon or methane, into building interiors. For example, Section 9.13.4 of the most recent Ontario Building Code outlines construction requirements to be met for reducing or preventing the ingress of soil gas into a building.

Radon is a colourless and odorless radioactive gas that occurs naturally as a result of the decay of radium. It is found to varying degrees as a component of soil gas in generally all regions of Canada and the United States, and is known to enter buildings by infiltration into basements and crawl spaces. The presence of the decay products of radon in sufficient quantity is known to increase the risk of lung cancer.

Soil gas barrier systems have been described. For example, Great Britain Patent No. 2261002 to Oliver describes a vented structure that rests on a substrate and comprises a shuttering element including pillars and an upper surface which supports cast material in the form of a slab or beam. The pillars are spaced from each other and provide passageways allowing gas emerging from the substrate to be vented safely away via a pipe.

U.S. Pat. No. 9,803,356 to Fox describes a building panel that may be installed below a slab in the construction of buildings. The building panel supports the slab and also provides a ventilation layer that may be depressurized to eliminate or reduce infiltration of radon gas into the building. The ventilation layer may comprise channels which provide a two-dimensionally interconnected void. Ventilation panels which include collars for connecting to ventilation systems may be provided. The panels may be installed directly on compacted soil. The building panels may additionally provide sub-slab insulation and/or a capillary break for water drainage. In some embodiments the building panels are formed substantially entirely of thermal insulating material such as rigid polystyrene foam.

Improvements are generally desired. It is therefore at least an object to provide a novel soil gas barrier system and a ventilation panel for same.

SUMMARY OF THE INVENTION

It should be appreciated that this summary is provided to introduce a selection of concepts in a simplified form that are further described below in the detailed description. This summary is not intended to be used to limit the scope of the claimed subject matter.

Accordingly, in one aspect, there is provided a ventilation panel for a soil gas barrier system, the ventilation panel comprising: an insulating foam body having first and second opposing faces and a plurality of grooves to define, in cross-section, an interconnected plurality of ventilation channels having walls that extend into the ventilation panel from the second face toward the first face; and a film of substantially gas-impervious material attached to at least one of the first face and the second face.

The first face may define a surface on which a concrete basement floor slab is cast.

The insulating foam body may have side surfaces between the first face and the second face, and the interconnected plurality of ventilation channels may be accessible from at least one of the side surfaces.

The plurality of channels may comprise a plurality of first channels intersecting a plurality of second channels, each first channel having a wall extending across at least a portion of the width of an opposing second channel.

The grooves may further define, in cross-section, a plurality of first pedestals having a first shape and a plurality of second pedestals having a second shape. The first pedestals may be interposed between four nearest second pedestals, and the second pedestals may be interposed between four nearest first pedestals. The first pedestals may have a cylindrical shape and the second pedestals may have a rounded shape.

The insulating foam body may further comprise connecting features for connecting to an abutting panel. The connecting features may comprise a tongue formed on a first side surface, and a groove formed on an opposite side surface.

The first face may have at least one underfloor heating groove formed therein, the at least one underfloor heating groove being sized to accommodate underfloor heating tubing. The first face may have a plurality of upper pedestals formed therein, the upper pedestals being sized to accommodate underfloor heating tubing therebetween.

The panel may comprise a first film of gas-impervious material attached to the first face, and a second film of gas-impervious material attached to the second face. The first film and the second film may be separate films. The second film may conform to the walls of the channels and to the bottoms of the grooves.

In another aspect, there is provided a soil gas barrier system for a building, comprising: a plurality of soil gas barrier ventilation panels, each ventilation panel comprising: an insulating foam body having first and second opposing faces and a plurality of grooves to define, in cross-section, an interconnected plurality of ventilation channels having walls that extend into the ventilation panel from the second face toward the first face; and a film of substantially gas-impervious material attached to at least one of the first face and the second face; and a ventilation stack in fluid communication with the ventilation channels of the plurality of ventilation panels, the ventilation stack being configured to convey soil gas to an exterior of the building for discharge.

BRIEF DESCRIPTION OF THE DRAWINGS

Embodiments will now be described more fully with reference to the accompanying drawings in which.

DETAILED DESCRIPTION OF THE EMBODIMENTS

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Figure 1:
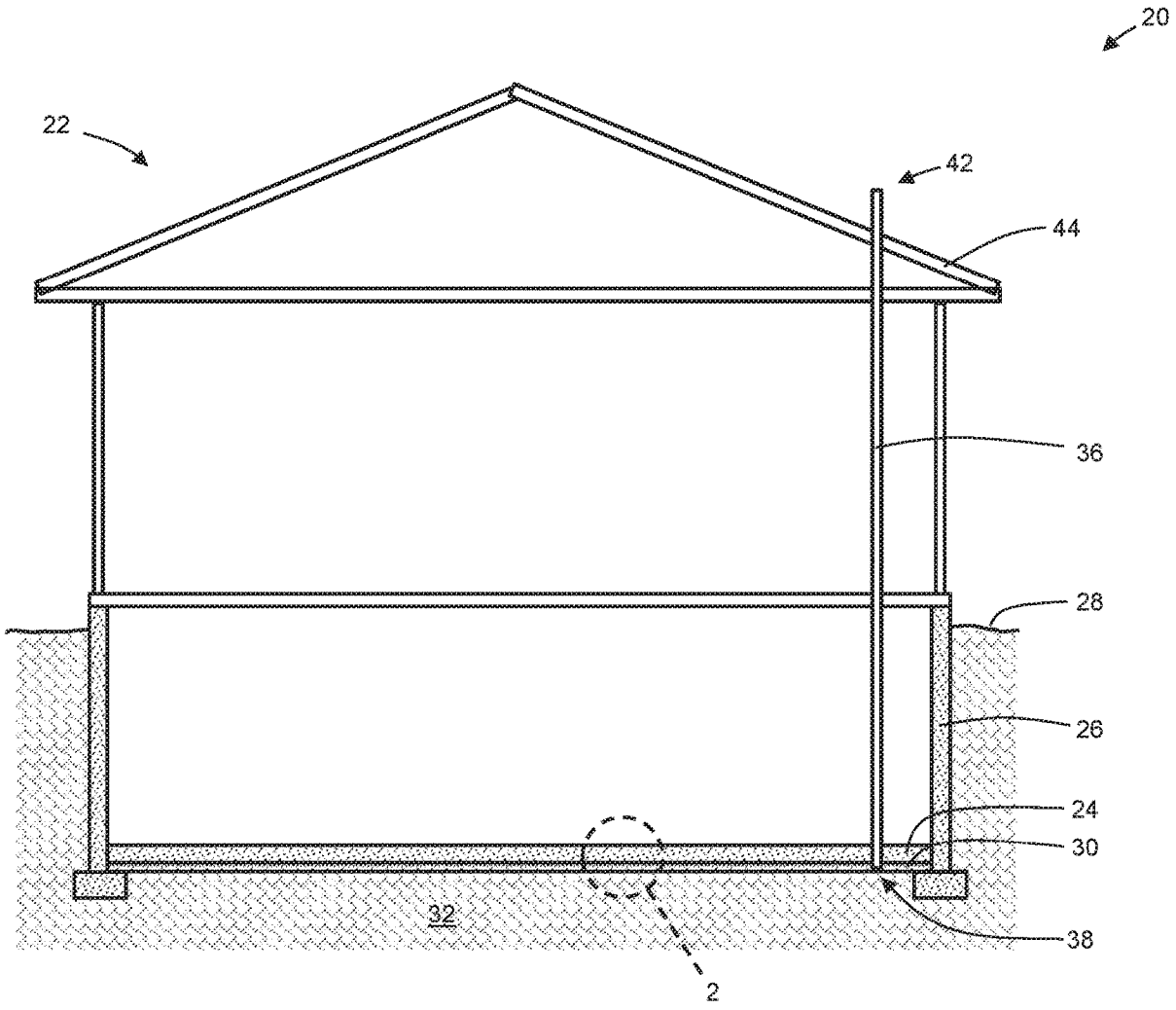
FIG. 1 is a schematic view of a soil gas barrier system installed in a building.
Figure 2:
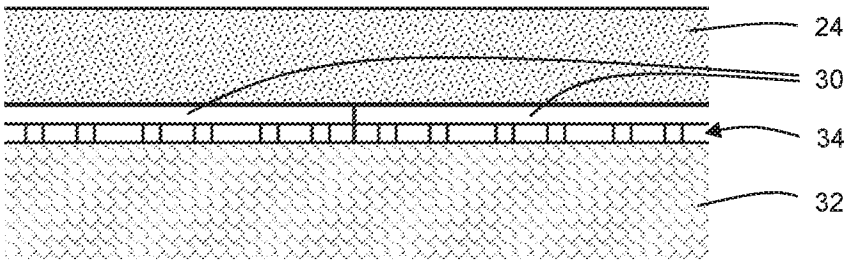
FIG. 2 is an enlarged fragmentary view of a portion of the soil gas barrier system of FIG. 1.
Figure 3:
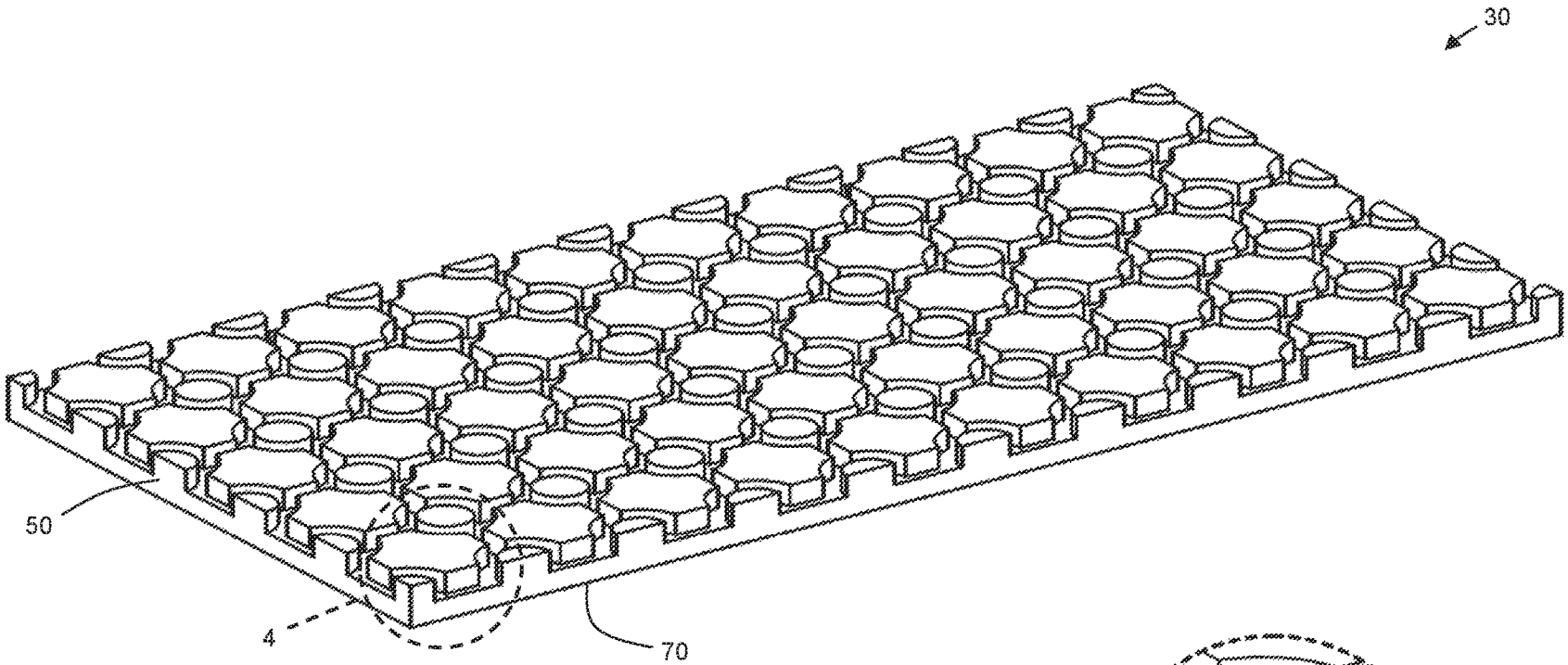
FIG. 3 is a perspective view of a ventilation panel forming part of the soil gas barrier system of FIG. 1.
Figure 4:
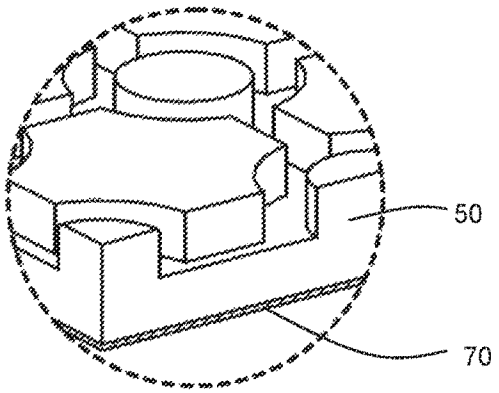
FIG. 4 is an enlarged fragmentary view of the ventilation panel of FIG. 3.
Figure 5:
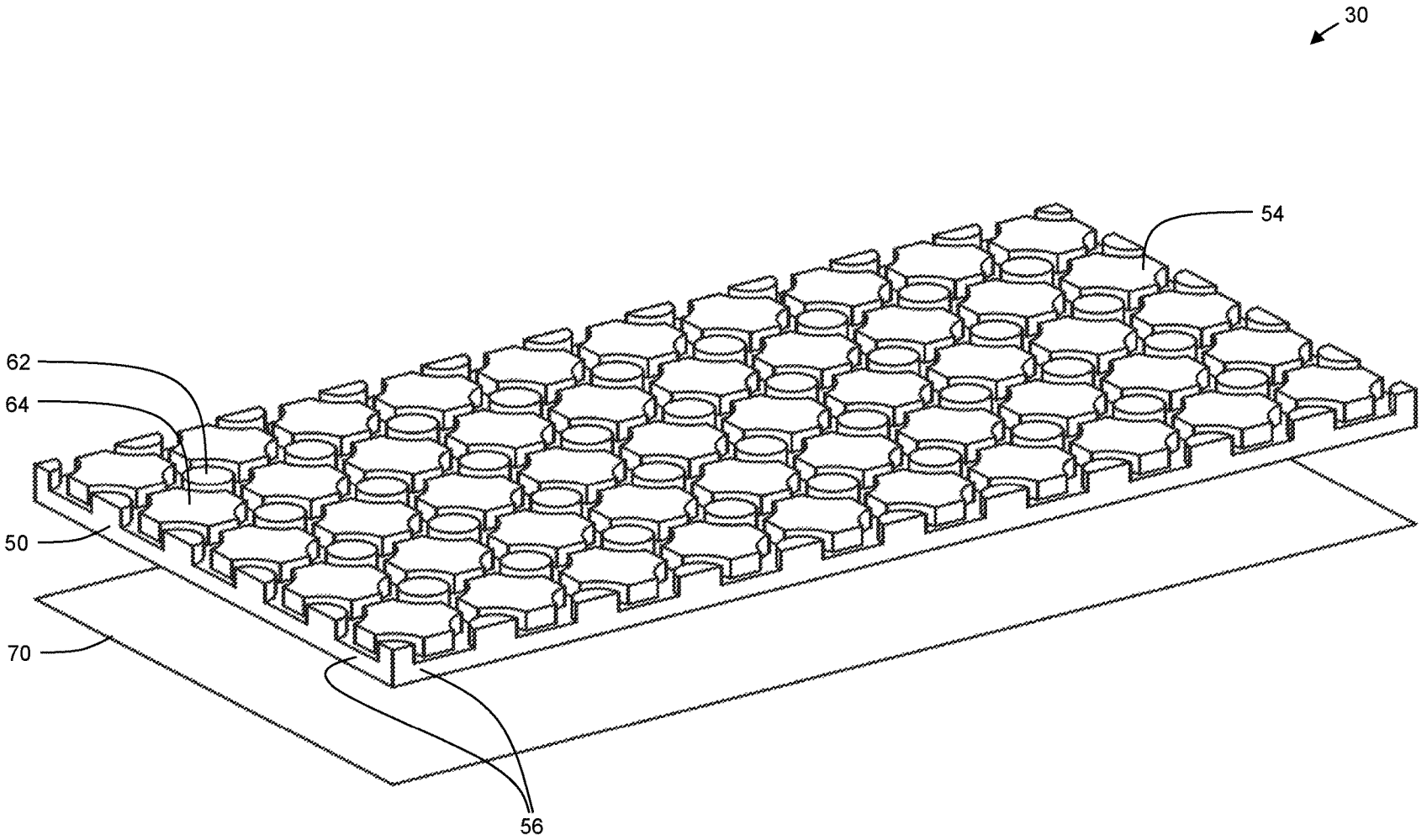
FIG. 5 is an exploded perspective view of the ventilation panel of FIG. 3.
Figure 7:
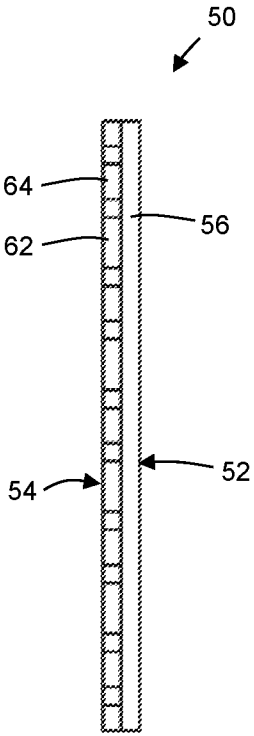
FIG. 7 is a side view of the foam body of FIG. 6.
Figure 6:
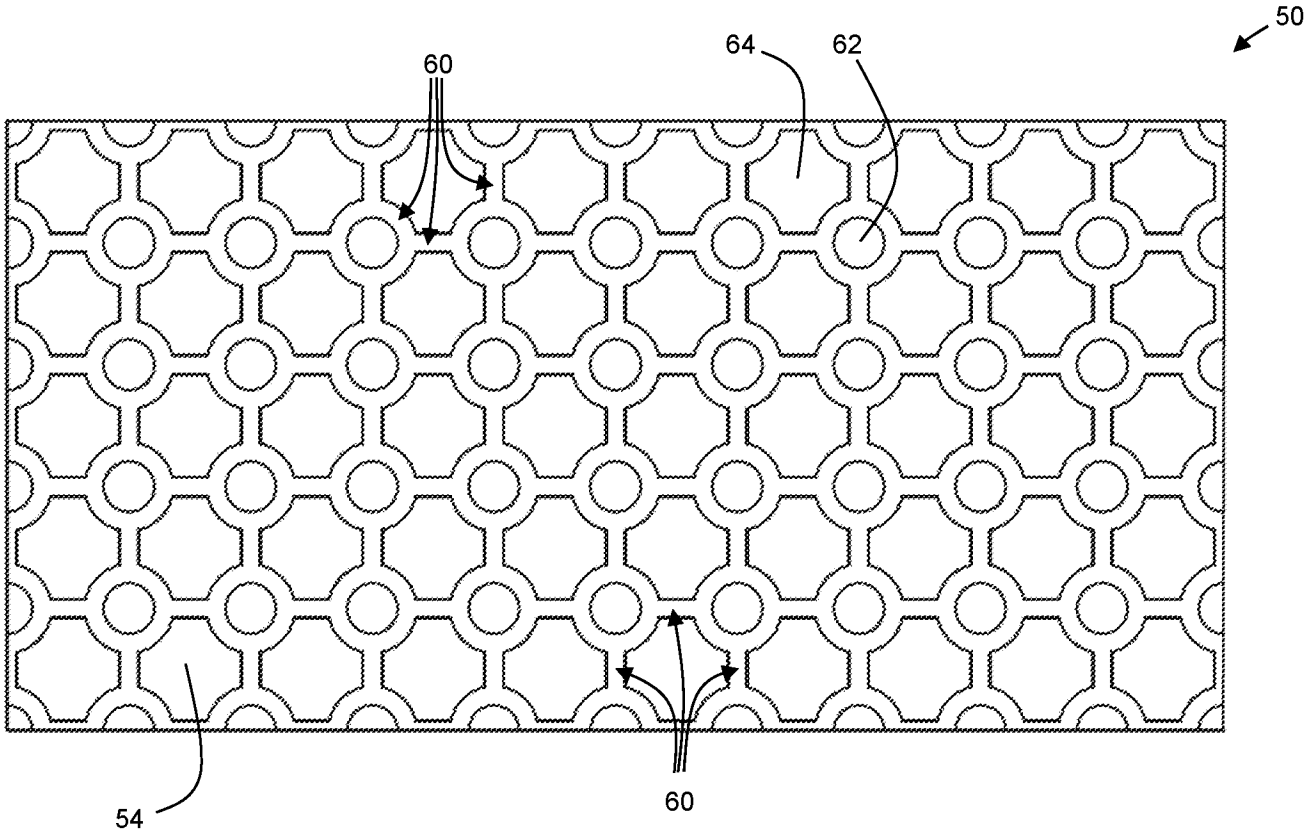
FIG. 6 is a bottom view of an insulating foam body forming part of the ventilation panel of FIG. 3.
Figure 8:
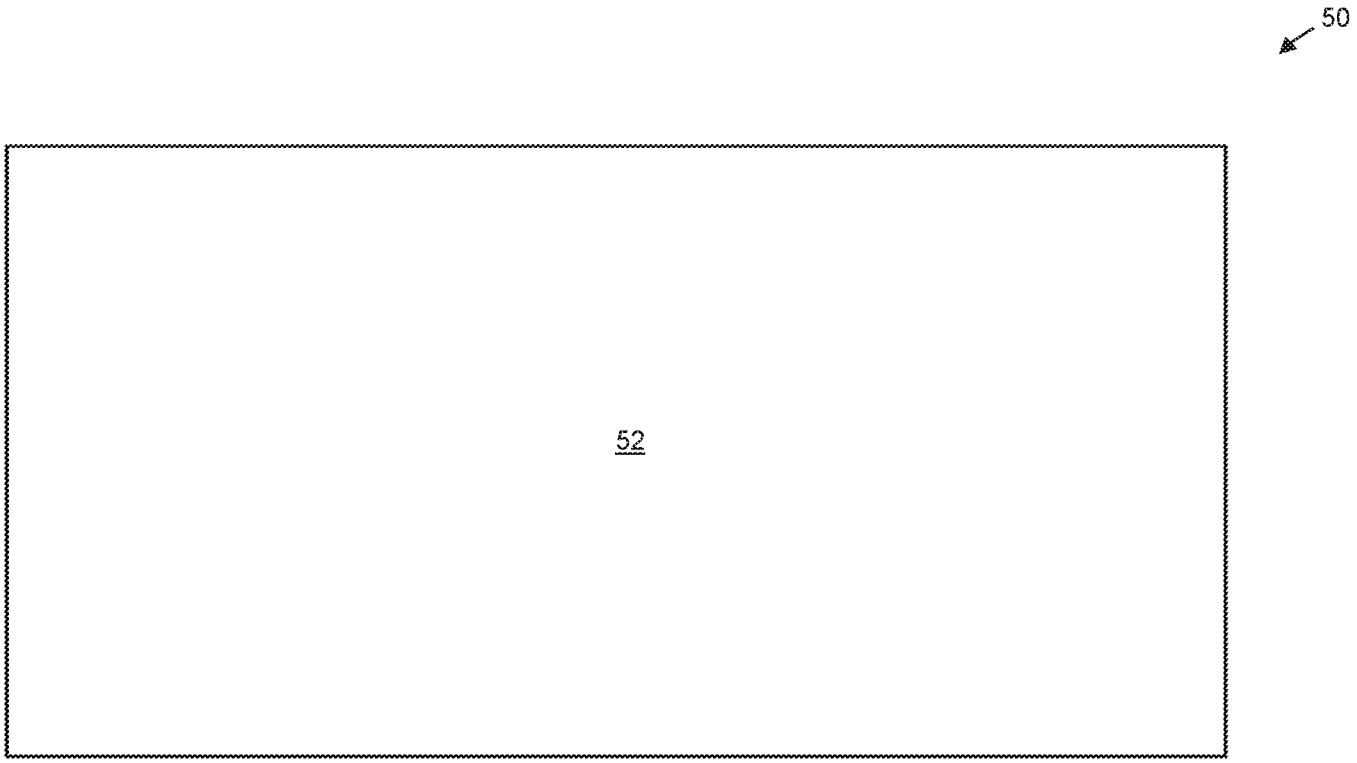
FIG. 8 is a top view of the foam body of FIG. 6.

Turning now to FIGS. 1 and 2, a soil gas barrier system is shown and is generally indicated by reference numeral 20. The soil gas barrier system 20 is configured to reduce or prevent entry of soil gas, such as radon and/or methane, into the interior of a building 22. In the example shown, the building 22 is a residential building, and in particular a house, and comprises a basement having a basement floor slab 24 and foundation walls 26 constructed below grade 28. However, it will be understood that the soil gas barrier system 20 may alternatively be used in another kind of residential building, or in a commercial building.

The soil gas barrier system 20 includes a layer of ventilation panels 30 that underlie the basement floor slab 24, and that overlie ground 32 on which building 22 is constructed. The ventilation panels 30 are configured to serve as a barrier to soil gas flowing upward from the ground 32 toward the building 22. In particular, the ventilation panels 30 are shaped to define an interconnected ventilation volume 34 below the basement floor slab 24, in fluid communication with a stack 36. The stack 36 extends from an input end 38 positioned below the basement floor slab 24, upwards through the building 22 to a discharge end 42 positioned above the roof 44 of the building 22. As will be understood, the stack 36 is configured to convey soil gas from the interconnected ventilation volume 34 via the input end 38 up to the discharge end 42, where it is discharged exterior of the building 22. Although not shown in this embodiment, the soil gas barrier system 20 may further comprise a pump (not shown) or a fan (not shown) in fluid communication with the interior of the stack 36, and which is configured to draw the soil gas upward through the stack 36.

The ventilation panel 30 may be better seen in FIGS. 3 to 8. The ventilation panel 30 comprises a foam body 50 fabricated of insulating foam. In this embodiment, the foam body 50 is fabricated of expanded polystyrene (EPS) foam by "shape molding", whereby expandable polystyrene beads (not shown) are heated in a suitably shaped mold (not shown), as is known in the art. The foam body 50 has a first face 52, a second face 54 opposite the first face 52, and a plurality of side surfaces 56 adjacent and extending between the first face 52 and the second face 54.

In this embodiment, the first face 52 is generally planar, and provides a surface onto which concrete is to be poured to cast the basement floor slab 24. The second face 54 has a plurality of grooves formed therein that provide an interconnected network of ventilation channels 60, each of which provides a fluid passageway through which soil gas can flow toward the input end 38 of the stack 36 during use. The grooves, in turn, define a plurality of first pedestals 62 and a plurality of second pedestals 64, each of which have one or more walls that extend into the foam body 50 from the second face 54 toward the first face 52. It will be understood that the walls of the pedestals 62 and 64 also define the walls of the ventilation channels 60. In this embodiment, the first pedestals 62 each have a cylindrical profile, and the second pedestals 64 each have a "rounded cross"-shaped profile with rounded inner corners. As will be understood, the cylindrical and "rounded cross"-shapes of the pedestals 62 and 64 reduce the total length of aligned linear edges on the second face 54 of the foam body 50. Additionally, the pedestals 62 and 64 are arranged in an alternating and interspersed pattern, such that aligned linear edges defined by pedestals 64 are interrupted by pedestals 62. In this manner, a wall of one first pedestal 62 extends across the width of a ventilation channel 60 defined between adjacent second pedestals 64. Further, by the alternating and interspersed pattern, each first pedestal 62 is interposed between four nearest second pedestals 64, and each second pedestal 64 is interposed between four nearest first pedestals 62.

The ventilation panel 30 also comprises a gas-impervious film 70 attached to the first face 52 of the foam body 50. The gas-impervious film 70 to is configured to effectively resist the passage of soil gas therethrough, during use. It will be understood that the gas-impervious film 70 is fabricated of material that is substantially gas-impervious, meaning that the gas-impervious film 70 permits only an insignificant amount of gas, if any, to pass therethrough. In this embodiment, the gas-impervious film 70 is a thin sheet of polymer, such as high-impact polystyrene, polypropylene or polyester, and is attached to the first face 52 of the foam body 50 by laminating.

During construction of building 22, ventilation panels 30 are laid on ground 32 in a side-by-side manner, such that the side surfaces 56 of adjacent ventilation panels 30 abut. In particular, the ventilation panels 30 are laid such that the second face 54 of each ventilation panel 30 is oriented downwardly toward the ground 32, and such that the first face 52 of each ventilation panel 30 is oriented upwardly. When oriented in this manner, the ventilation channels 60 of adjacent ventilation panels 30 are in fluid communication with each other and define the interconnected ventilation volume 34. A lower segment of the stack 36 is installed through at least one of the ventilation panels 30 such that the input end 38 is in fluid communication with the ventilation channels 60, and therefore with the interconnected ventilation volume 34. With the lower segment of the stack 36 installed, concrete is poured onto the ventilation panels 30 to form the basement floor slab 24. During subsequent construction of the building 22, the stack 36 is completed such that the discharge end 42 is positioned above the exterior of the building 22. In use, soil gas moving upwardly from the ground 32 is impeded by the gas-impervious film 70 and the foam body 50, and flows laterally through the ventilation channels 60 to the input end 38 of the stack 36, where it is drawn upwardly and is discharged to atmosphere exterior to the building 22.

As will be appreciated, the gas-impervious film 70 advantageously enables the panel 30 to have increased resistance to breakage. As will be understood, the corners and edges of the foam body 50 can otherwise be prone to chipping or damage, which may otherwise arise during any of transportation and installation. The inventor of the subject application has found that employing the gas-impervious film 70 not only prevents soil gas and moisture from permeating through the panel 30, but also increases the structural integrity of the panel 30. In this way, physical pressures both during construction, and when construction is complete, can be better withstood.

As will be appreciated, the cylindrical and "rounded cross"-shapes of the pedestals 62 and 64 reduce the number of stress concentration points and stress concentration lines on the second face 54 of the foam body 50. As will be understood, the reduced number of stress concentration points and stress concentration lines advantageously renders the foam body less susceptible to breakage and thereby increases the inherent strength of the foam body 50.

As will be appreciated, the alternating and interspersed arrangement of the pedestals 62 and 64 reduces the total length of aligned linear edges on the second face 54 of the foam body 50, and thereby reduces the number of stress concentration lines on the surface of the foam body 50. As will be understood, the reduced number of stress concentration lines advantageously renders the foam body less susceptible to breakage and thereby increases the inherent strength of the foam body 50.

Although in the embodiment described above, the foam body 50 is fabricated of insulating foam by "shape molding" using a mold, in other embodiments, the foam body may alternatively be fabricated by shaping a large block (not shown) of insulating foam with a router (not shown) to form the foam body. In such an embodiment, the large block would be fabricated by "shape molding" using a suitably-shaped mold, and would then be shaped with a router to define grooves (and therefore the interconnected network of ventilation channels) to form the foam body. In another such embodiment, the large block formed by shape molding could be cut into one or more thinner slabs (not shown), and each thinner slab would then be shaped with the router to form the foam body. By either approach, after shaping with the router, the gas-impervious film 70 could be attached to the first face of the foam body by laminating. Alternatively, by either approach, the gas-impervious film 70 could be attached by laminating to the (unshaped) large block or the (unshaped) thinner slab prior to routing, after which shaping with the router could be carried out to form the ventilation panel.

Figure 9:
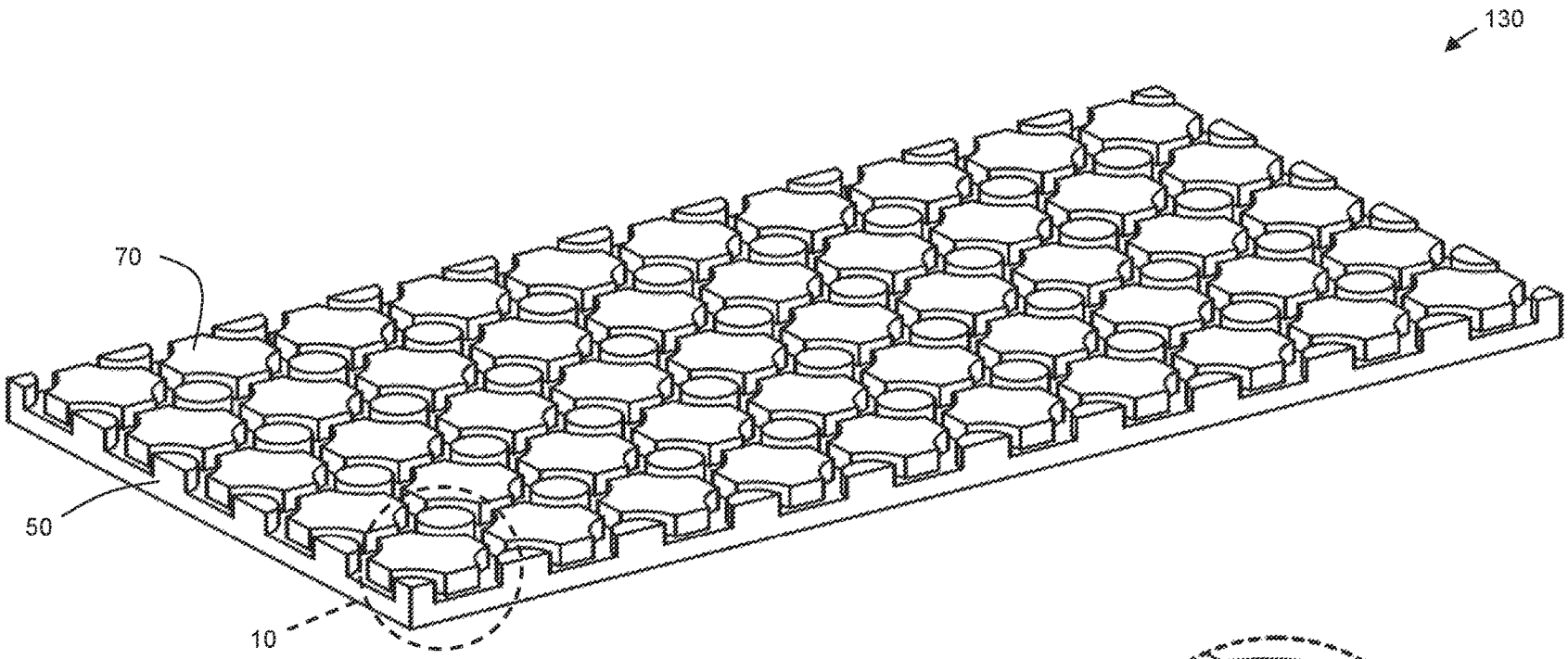
FIG. 9 is a perspective view of another embodiment of a ventilation panel forming part of the soil gas barrier system of FIG. 1.
Figure 10:
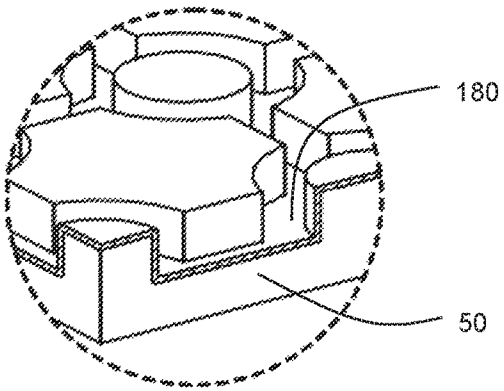
FIG. 10 is an enlarged fragmentary view of the ventilation panel of FIG. 9.
Figure 11:
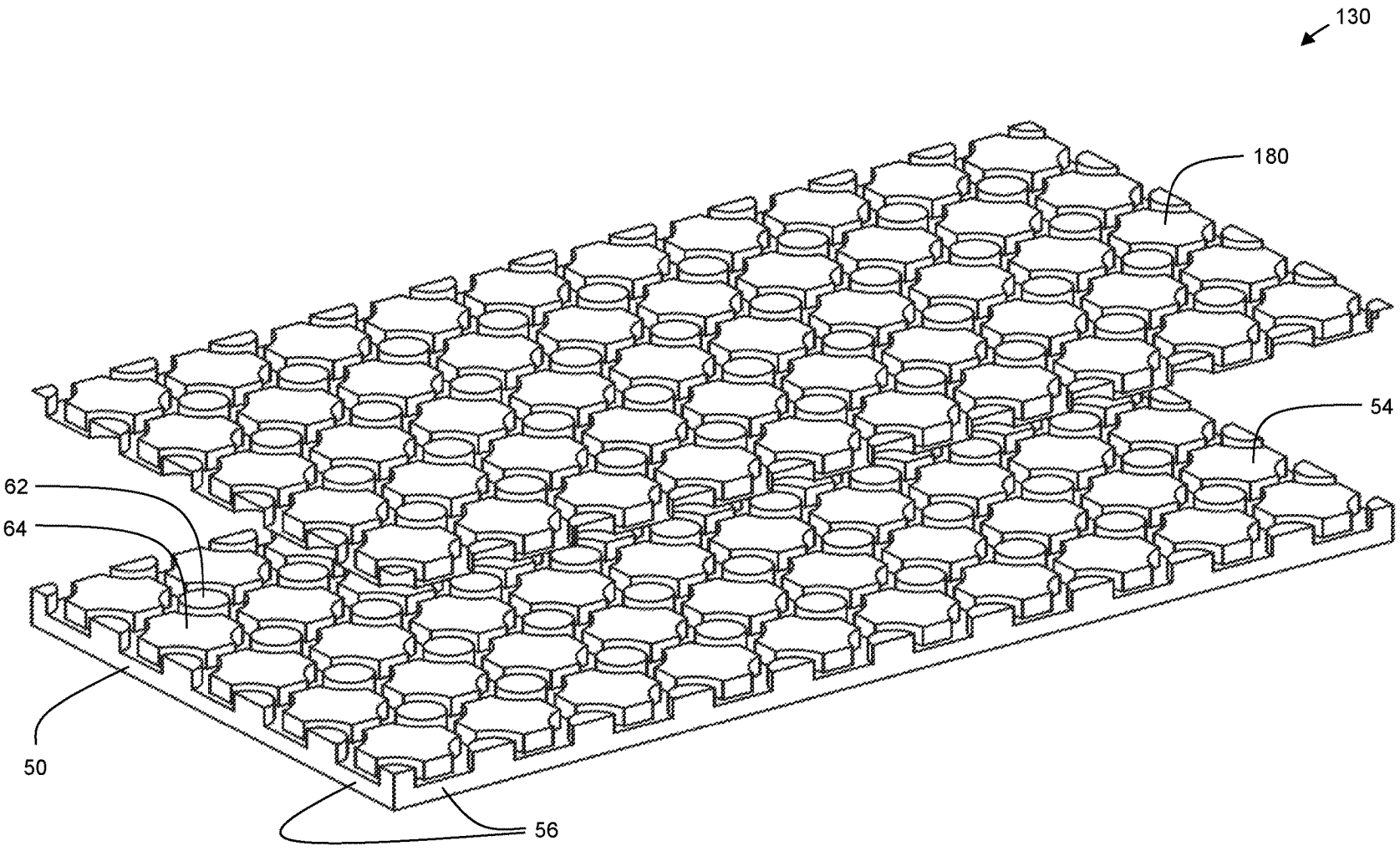
FIG. 11 is an exploded perspective view of the ventilation panel of FIG. 9.

In other embodiments, the ventilation panel may be differently configured. For example, FIGS. 9 to 11 show another embodiment of a ventilation panel, which is generally indicated by reference numeral 130. Ventilation panel 130 is similar to ventilation panel 30 described above and with reference to FIGS. 3 to 8, and comprises the foam body 50 fabricated of insulating foam. In this embodiment, the foam body 50 is fabricated of expanded polystyrene (EPS) foam by "shape molding". As described above, the foam body 50 has the first face 52, the second face 54 opposite the first face 52, and the plurality of side surfaces 56 adjacent and extending between the first face 52 and the second face 54. The first face 52 is generally planar, and provides the surface onto which concrete is to be poured to cast the basement floor slab 24. The second face 54 has the plurality of grooves formed therein that provide the interconnected network of ventilation channels 60, each of which provides a fluid passageway through which soil gas can flow toward the input end 38 of the stack 36 during use. The grooves, in turn, define the plurality of first pedestals 62 and the plurality of second pedestals 64, each of which have one or more walls that extend into the foam body 50 from the second face 54 toward the first face 52.

The ventilation panel 130 also comprises a gas-impervious film 180 attached to the second face 54 of the foam body 50, and which conforms to the pedestals 62 and 64. In this embodiment, the gas-impervious film 180 is a thin sheet of high-impact polystyrene, and becomes attached during "shape molding" of the foam body 50. In particular, the thin sheet of polymer is placed at a suitable position in the mold, such as against an interior surface of the mold, prior to formation of the foam body 50. In this manner, the gas-impervious film 180 becomes attached to the foam body 50 such that the gas-impervious film 180 is affixed to the tops and walls of the pedestals 62 and 64 and to the bottoms of the grooves. It will be understood that because the gas-impervious film 180 conforms to the pedestals 62 and 64, the ventilation channels 60 remain as an interconnected network, and each ventilation channel 60 provides a fluid passageway through which soil gas can flow toward the input end 38 of the stack 36 during use.

As will be appreciated, the gas-impervious film 180 advantageously enables the pedestals 62 and 64 to which the gas-impervious film conforms to have increased resistance to breakage. As will be understood, the corners and edges of the ventilation panel 130 can otherwise be prone to chipping or damage. In particular, the corners and edges of the pedestals 62 and 64 are prone to being broken away during any of transportation and installation. The inventor of the subject application has found that employing the gas-impervious film 180 not only prevents soil gas and moisture from permeating through the panel 130, but also increases the structural integrity of the panel 130 through conformation of the gas-impervious film 180 to the surfaces of the pedestals 62 and 64 and to the grooves therebetween. In this way, physical pressures both during construction, and when construction is complete, can be better withstood.

Although in the embodiment described above, the gas-impervious film 180 becomes attached during "shape molding" of the foam body 50 by placing it at a suitable position in the mold, such as against an interior surface of the mold, prior to formation of the foam body 50, in other embodiments, the gas-impervious film 180 may alternatively be attached after formation of the foam body 50. In one such embodiment, the mold may be opened, the thin sheet of polymer inserted, the mold closed with the foam body 50 and the thin sheet of polymer inside, and an additional molding or heating cycle carried out to fuse or laminate the thin sheet of polymer against the foam body 50 to thereby form the gas-impervious film 180.

Figure 12:
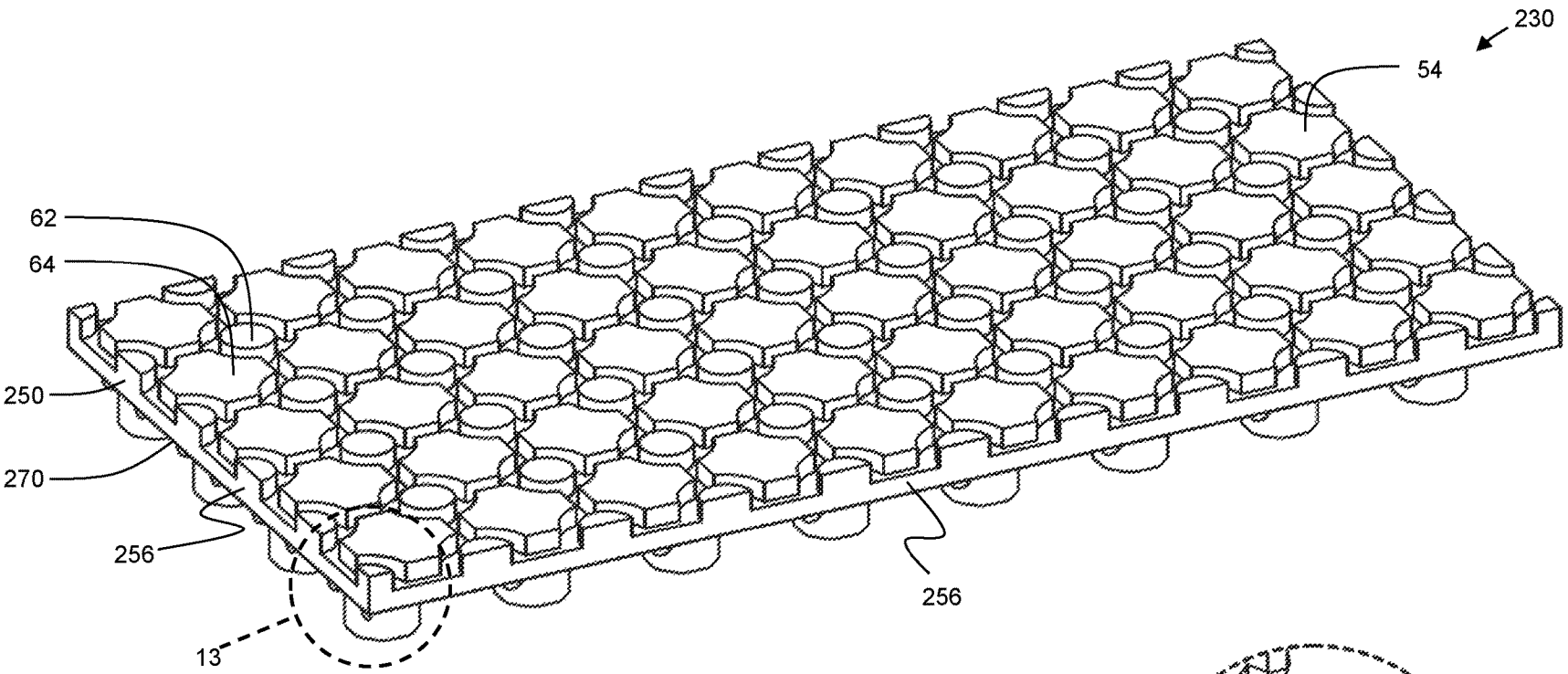
FIG. 12 is a perspective view of still another embodiment of a ventilation panel forming part of the soil gas barrier system of FIG. 1.
Figure 13:
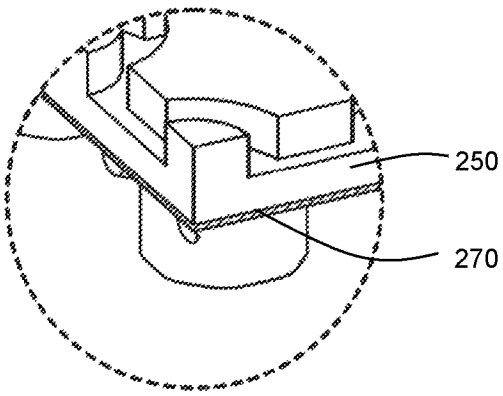
FIG. 13 is an enlarged fragmentary view of the ventilation panel of FIG. 12.
Figure 14:
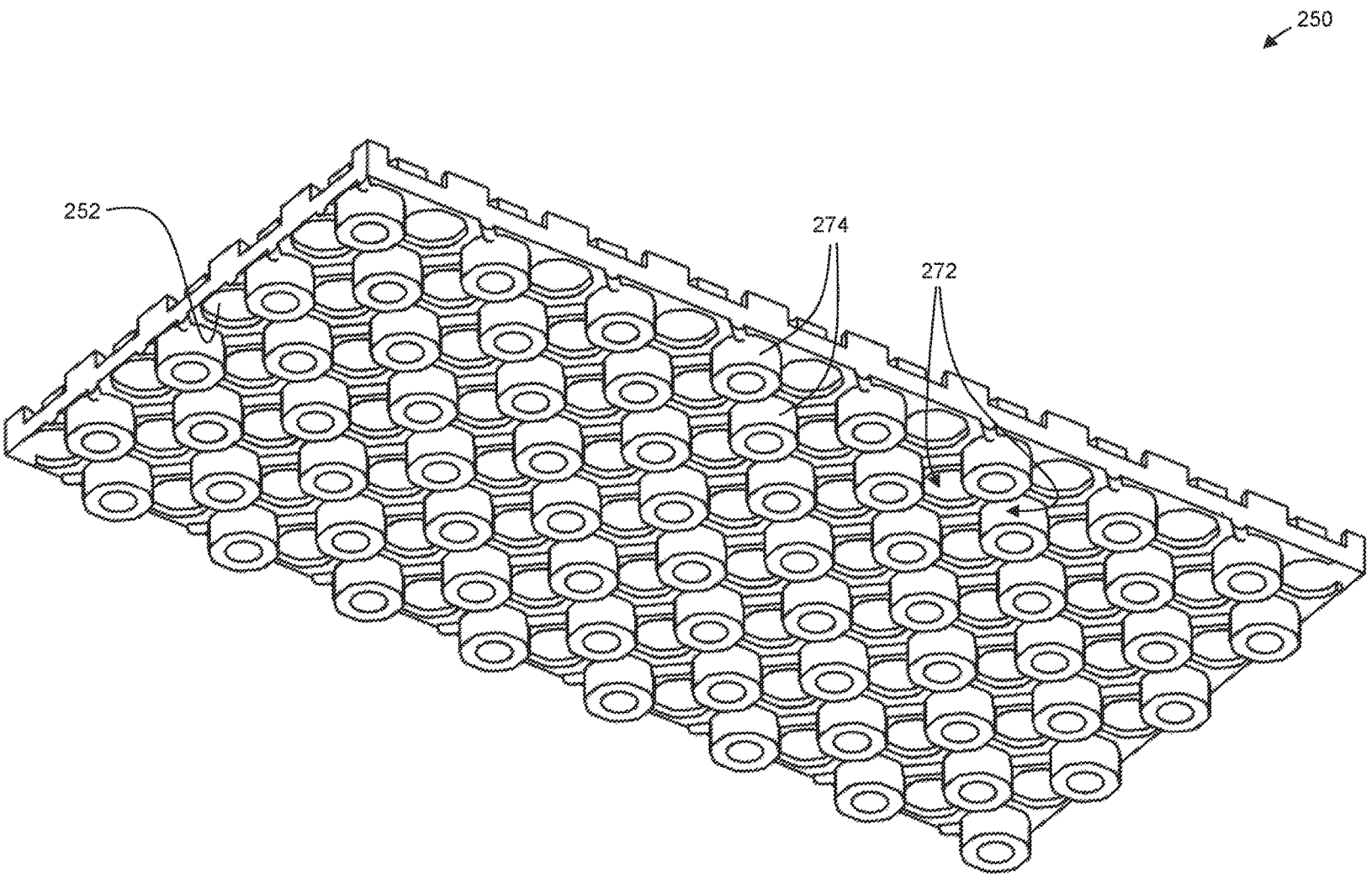
FIG. 14 is a perspective view of an insulating foam body forming part of the ventilation panel of FIG. 12.
Figure 15:
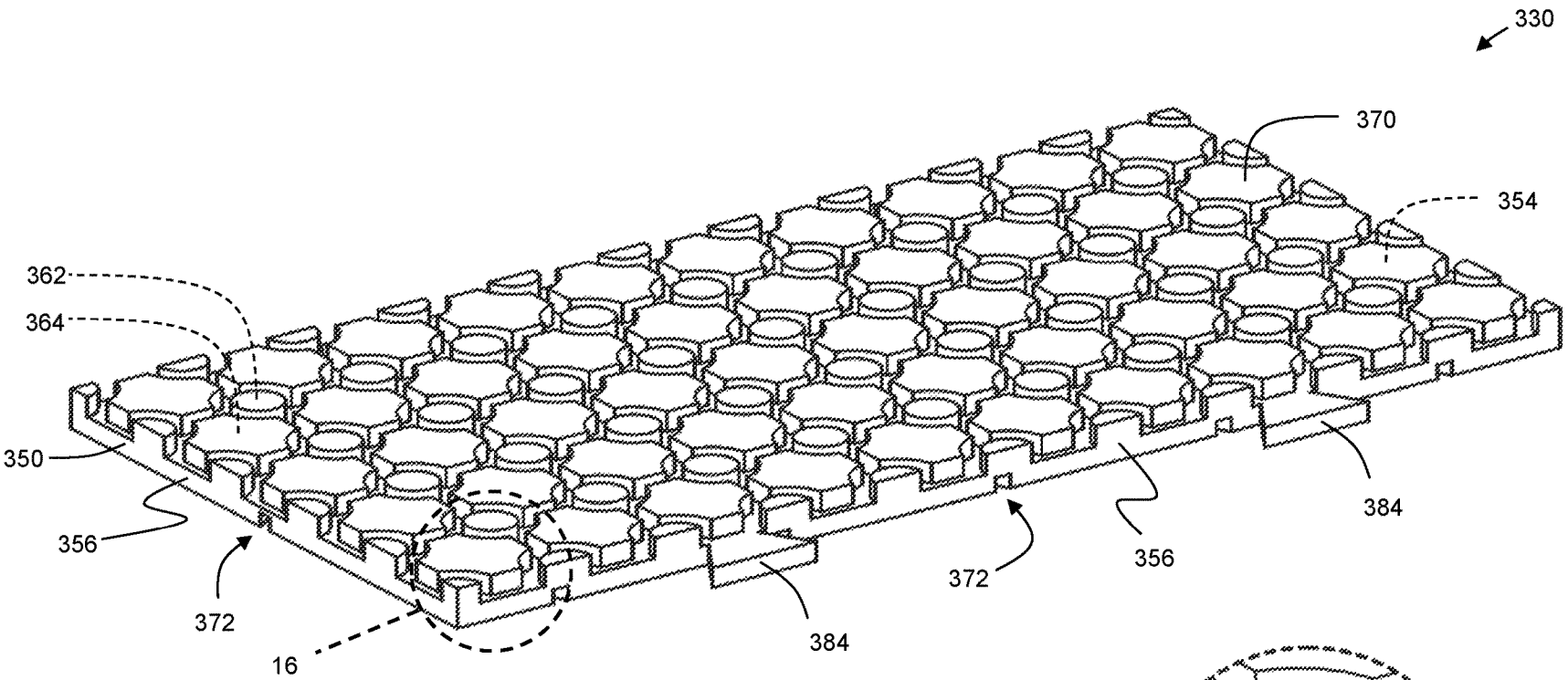
FIG. 15 is a perspective view of another embodiment of a ventilation panel forming part of the soil gas barrier system of FIG. 1.
Figure 16:
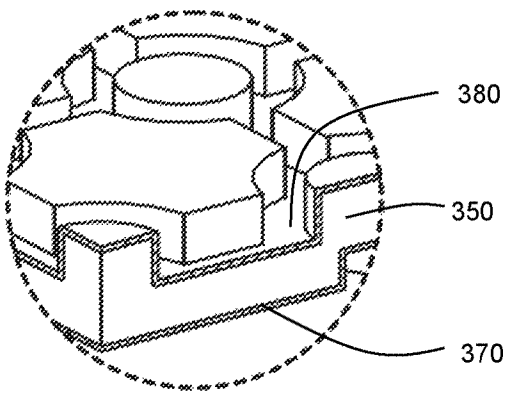
FIG. 16 is an enlarged fragmentary view of the ventilation panel of FIG. 15.
Figure 17:
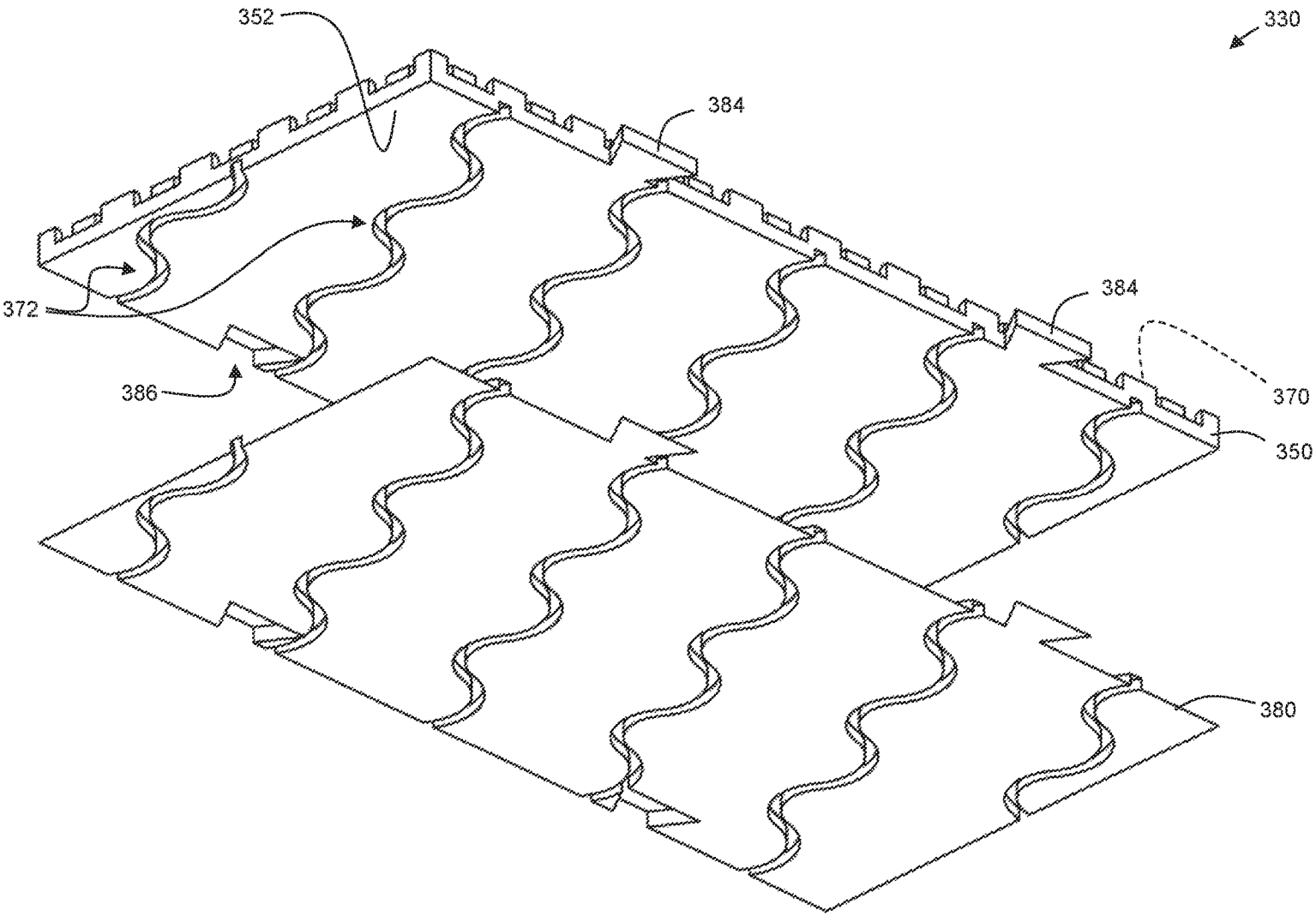
FIG. 17 is an exploded perspective view of the ventilation panel of FIG. 15.
Figure 18:
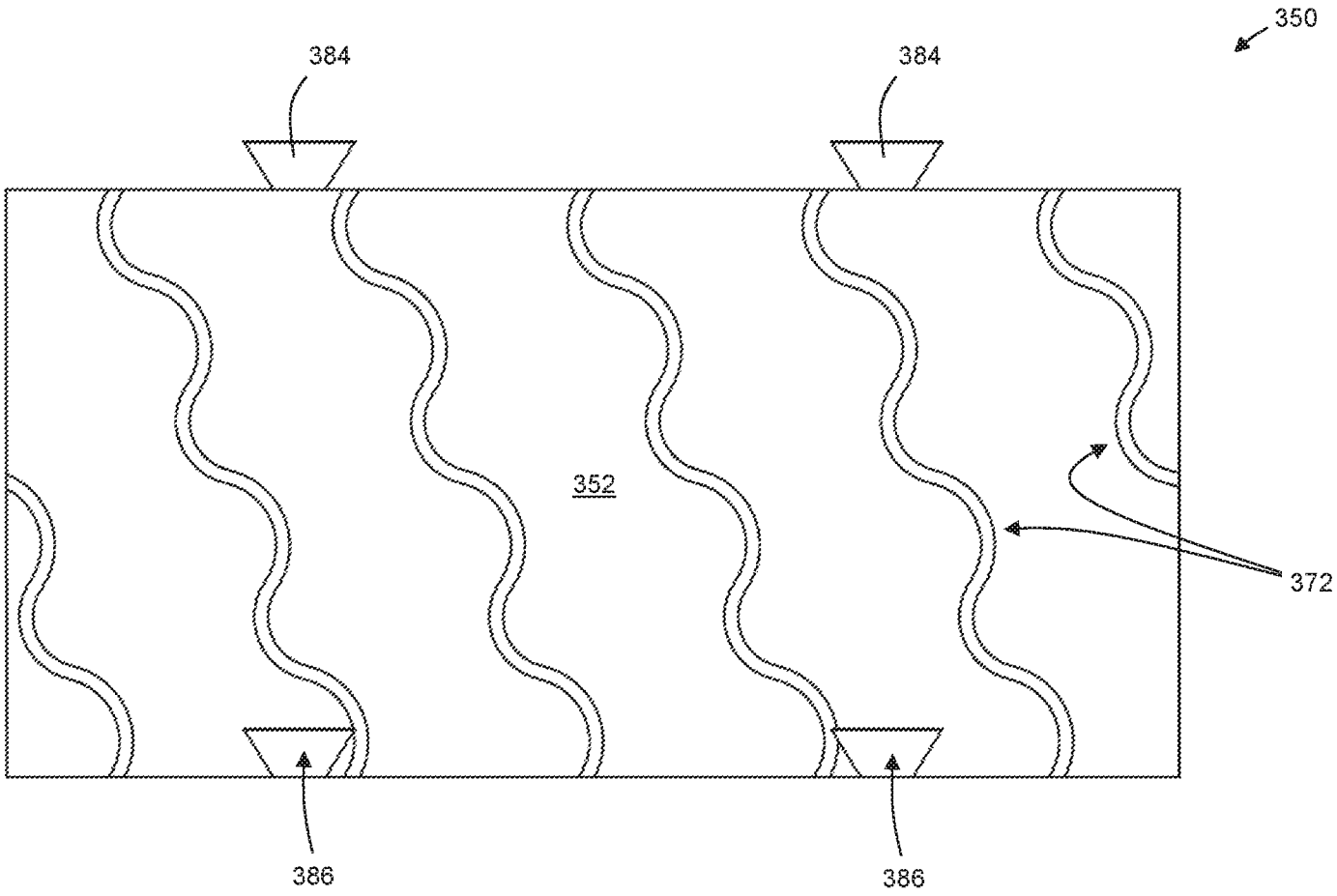
FIG. 18 is a top view of an insulating foam body forming part of the ventilation panel of FIG. 15.

Still other configurations of the panel are possible. For example, FIGS. 12 to 14 show still another embodiment of a ventilation panel, which is generally indicated by reference numeral 230. Ventilation panel 230 is similar to ventilation panel 30 described above and with reference to FIGS. 3 to 8, and comprises a foam body 250 fabricated of insulating foam. In this embodiment, the foam body 250 is fabricated of expanded polystyrene (EPS) foam by "shape molding". The foam body 250 has a first face 252, a second face 254 opposite the first face 252, and a plurality of side surfaces 256 adjacent and extending between the first face 252 and the second face 254.

The second face 254 is shaped similarly to the second face 54 of foam body 50 described above. The second face 254 has a plurality of grooves formed therein that provide an interconnected network of ventilation channels 260, each of which provides a fluid passageway through which soil gas can flow toward the input end 38 of the stack 36 during use. The grooves, in turn, define a plurality of first pedestals 262 and a plurality of second pedestals 264, each of which have one or more walls that extend into the foam body 250 from the second face 254 toward the first face 252. It will be understood that the walls of the pedestals 262 and 264 also define the walls of the ventilation channels 260. In this embodiment, the first pedestals 262 each have a cylindrical profile, and the second pedestals 264 each have a "rounded cross"-shaped profile with rounded inner corners. The pedestals 262 and 264 are arranged in an alternating and interspersed pattern.

In this embodiment, the first face 252 is generally non-planar, but nonetheless provides a surface onto which concrete is to be poured to cast the basement floor slab 24. The first face 252 has a plurality of underfloor heating grooves 272 formed therein for accommodating underfloor heating tubing (not shown) or underfloor heating elements (not shown). The grooves, in turn, define a plurality of pedestals 274 that extend into the foam body 250 from the first face 252 toward the second face 254. In this embodiment, the pedestals 274 each have a generally cylindrical profile.

The ventilation panel 230 also comprises a gas-impervious film 270 attached to the first face 252 of the foam body 250, and which conforms to the pedestals 274. In this embodiment, the gas-impervious film 270 is a thin sheet of high-impact polystyrene, and becomes attached during "shape molding" of the foam body 250. In particular, the thin sheet of polymer is placed at a suitable position in the mold, such as against an interior surface of the mold, prior to formation of the foam body 250. Alternatively, the gas-impervious film 280 may be attached after formation of the foam body 250, opening the mold and positioning the thin sheet of polymer and the foam body 250 together, and then running an additional molding or heating cycle to fuse or laminate the thin sheet of polymer against the foam body 250 to thereby form the gas-impervious film 280.

Still other configurations are possible. For example, FIGS. 15 to 18 show another embodiment of a ventilation panel, which is generally indicated by reference numeral 330. Ventilation panel 330 is generally similar to ventilation panel 30 described above and with reference to FIGS. 3 to 8, and comprises a foam body 350 fabricated of insulating foam. In this embodiment, the foam body 350 is fabricated of expanded polystyrene (EPS) foam by "shape molding". The foam body 350 has a first face 352, a second face 354 opposite the first face 352, and a plurality of side surfaces 356 adjacent and extending between the first face 352 and the second face 354.

The second face 354 has a plurality of grooves formed therein that provide an interconnected network of ventilation channels 360, each of which provides a fluid passageway through which soil gas can flow toward the input end 38 of the stack 36 during use. The grooves, in turn, define a plurality of first pedestals 362 and a plurality of second pedestals 364, each of which have one or more walls that extend into the foam body 350 from the second face 354 toward the first face 352. It will be understood that the walls of the pedestals 362 and 364 also define the walls of the ventilation channels 360. In this embodiment, the first pedestals 362 each have a cylindrical profile, and the second pedestals 364 each have a "rounded cross"-shaped profile with rounded inner corners. The pedestals 362 and 364 are arranged in an alternating and interspersed pattern.

In this embodiment, the first face 352 is generally planar, but has a plurality of underfloor heating grooves 372 formed therein for accommodating underfloor heating tubing (not shown) or underfloor heating elements (not shown). The first face 352 is configured to provide a surface onto which concrete is to be poured to cast the basement floor slab 24.

In the example shown, the ventilation panel 330 comprises a gas-impervious film 370 attached to the first face 352 of the foam body 350, and which conforms to the bottoms of the underfloor heating grooves 372. The ventilation panel 330 also comprises a gas-impervious film 380 attached to the second face 354 of the foam body 350, and which conforms to the pedestals 362 and 364. In this embodiment, each of the gas-impervious films 370 and 380 is a thin sheet of high-impact polystyrene and becomes attached during "shape molding" of the foam body 350. Similar to embodiments described above, each of the thin sheets of polymer is placed at a suitable position in the mold, such as against an interior surface of the mold, prior to formation of the foam body 350. Alternatively, the gas-impervious films 370 and 380 may be attached after formation of the foam body 350, by opening the mold and positioning the thin sheets of polymer and the foam body 350 together, and then running an additional molding or heating cycle to fuse or laminate the thin sheets of polymer against the foam body 350 to thereby form the gas-impervious films 370 and 380.

The ventilation panel 330 also has features for connecting to adjacent ventilation panels 330 during use. In the example shown, the ventilation panel 330 comprises two connectors 384 extending from one of the side surfaces 356, and two receptacles 386 accessible from an opposite one of the side surfaces 356 and each sized and shaped to matingly receive one connector 384. In the example shown, each connector 384 has a surface that is co-planar with the first surface 352, and each receptacle 386 is shaped as a recess in the first surface 352.

As will be understood, the connectors 384 and receptacles 386 advantageously provide a tongue and groove arrangement for connecting adjacent ventilation panels 330, whereby the tongue of one ventilation panel is received in the groove of an adjacent ventilation panel. In other embodiments, other configurations are possible. For example, in other embodiments, the tongue and groove need not necessarily be coplanar with, or accessible from, the first face of the foam body. In still other embodiments, the tongues and grooves may be differently shaped. In one such embodiment, the groove may longitudinally extend the length of a respective side, and the tongue may longitudinally extend the length, or a portion of the length, of a respective side. The tongues and grooves may have square, rectangular configurations with or without rounded longitudinal corners. In still other embodiments, the foam body may alternatively have only grooves along the side surfaces, with each groove being configured to receive a connector for connecting adjacent ventilation panels. The connector may be, for example, a longitudinal connector strip comprising a central body and opposing tongues, with each tongue being shaped to be received by a respective groove. It will be understood that any of the above-described connecting features, such as connectors, receptacles, tongues and grooves, and/or longitudinal connector strips, can form part of and/or be used with, other embodiments of ventilation panels described herein.

Figure 19:
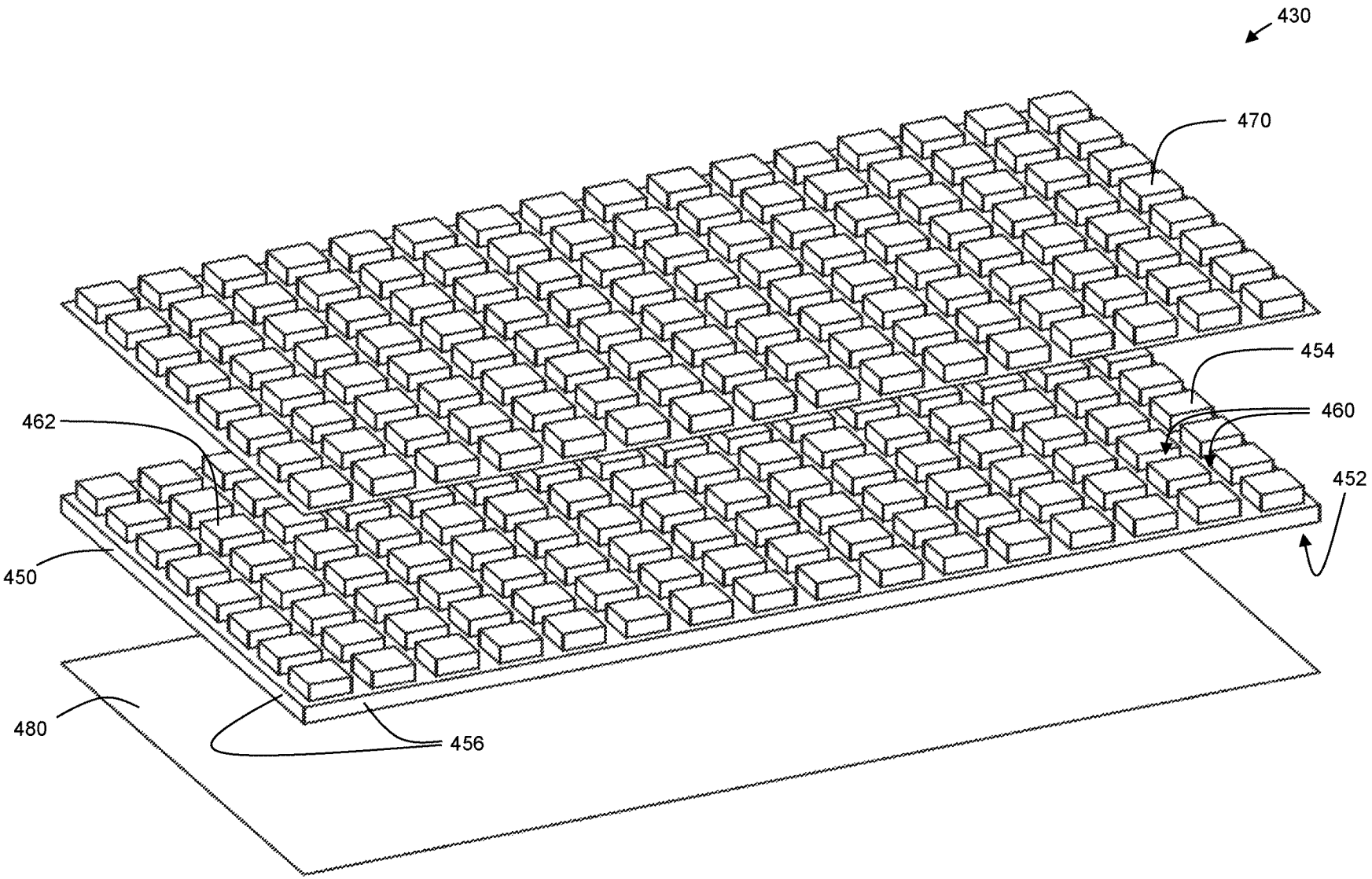
FIG. 19 is an exploded perspective view of still yet another embodiment of a ventilation panel forming part of the soil gas barrier system of FIG. 1.

In still other embodiments, the pedestals formed in the second face of the foam body may be differently shaped. For example, FIG. 19 shows another embodiment of a ventilation panel, which is generally indicated by reference numeral 430. Ventilation panel 430 is similar to ventilation panel 30 described above and with reference to FIGS. 3 to 8, and comprises a foam body 450 fabricated of insulating foam. In this embodiment, the foam body 450 is fabricated of expanded polystyrene (EPS) foam by "shape molding". The foam body 450 has a first face 452, a second face 454 opposite the first face 452, and a plurality of side surfaces 456 adjacent and extending between the first face 452 and the second face 454.

In this embodiment, the first face 452 is generally planar, and provides a surface onto which concrete is to be poured to cast the basement floor slab 24. The second face 454 has a plurality of grooves formed therein that provide an interconnected network of ventilation channels 460, each of which provides a fluid passageway through which soil gas can flow toward the input end 38 of the stack 36 during use. The grooves, in turn, define a plurality of pedestals 462, which each have walls that extend into the foam body 450 from the second face 454 toward the first face 452. It will be understood that the walls of the pedestals 462 also define the walls of the ventilation channels 460. In this embodiment, the pedestals 462 each have a square profile.

In the example shown, the ventilation panel 430 comprises a gas-impervious film 470 attached to the first face 452 of the foam body 450. The ventilation panel 430 also comprises a gas-impervious film 480 attached to the second face 454 of the foam body 450, and which conforms to the pedestals 462. In this embodiment, each of the gas-impervious films 470 and 480 is a thin sheet of high-impact polystyrene and becomes attached during "shape molding" of the foam body 450. Similar to embodiments described above, each of the gas-impervious films 470 and 480 is formed by placing the thin sheet of polymer at a suitable position in the mold, such as against an interior surface of the mold, prior to formation of the foam body 450. Alternatively, the gas-impervious films 470 and 480 may be attached after formation of the foam body 450, by opening the mold and positioning the thin sheets of polymer and the foam body 450 together, and then running a molding and/or heating cycle to fuse or laminate the thin sheets of polymer against the foam body 450 to thereby form the gas-impervious films 470 and 480.

Still other pedestal shapes are possible. For example, in other embodiments, the pedestals may alternatively be oval-shaped, diamond-shaped, hexagonal, rectangular, and/or may be of different sizes (e.g. a thin rectangle and a thick rectangle). Subfloor components comprising pedestals having such shapes have been disclosed in U.S. Pat. No. 8,650,823 to Amend, the content of which is incorporated herein by reference in its entirety. It will be understood that pedestals of different shapes, including others not described or mentioned above, or mixtures of differently-shaped pedestals such as those described or mentioned above, may be also provided.

Although in the embodiments described above, the foam body of the ventilation panel is fabricated of EPS foam, in other embodiments, the foam body may alternatively be fabricated of another suitable foam material, such as for example extruded polystyrene (XPS) foam.

Although in the embodiments described above, the pedestals are shown as been generally uniformly distributed across the foam body, in other embodiments, the pedestals may alternatively be non-uniformly distributed across the foam body.

Although in the embodiments described above, each gas-impervious film is attached to the foam body by laminating once the foam body has been molded, or becomes attached to the foam body during molding of the foam body, in other embodiments, the gas-impervious film may alternatively be attached to the foam body by a glue layer disposed between the foam body and the gas-impervious film, or by melting or partially melting either the gas-impervious film or a surface of the foam body using a suitable heat source, while applying vacuum to the film from an opposite face of the foam body using a vacuum source. The heat source may be, for example, a radiant heater, an infrared lamp, a hot air blower, a torch, and the like. Other suitable heat sources are known to those skilled in the art.

Although embodiments have been described above with reference to the accompanying drawings, those of skill in the art will appreciate that variations and modifications may be made without departing from the scope thereof as defined by the appended claims.

What is claimed is:

1. A ventilation panel for a soil gas barrier system, the ventilation panel comprising:

an insulating foam body having first and second opposing faces and a plurality of grooves to define, in cross-section, a plurality of first pedestals having a first shape and a plurality of second pedestals having a second shape, the first pedestals and the second pedestals each having at least one wall extending from the second face toward the first face defining a plurality of intersecting ventilation channels therebetween, the intersecting ventilation channels defining only three-way intersections; and a film of substantially gas-impervious material laminated or adhered to at least one of the first face and the second face.

2. The ventilation panel of claim 1, wherein the first face defines a surface on which a concrete basement floor slab is cast.

3. The ventilation panel of claim 1, wherein the insulating foam body has side surfaces between the first face and the second face, and wherein the interconnected plurality of ventilation channels are accessible from at least one of the side surfaces.

4. The ventilation panel of claim 1, wherein the first pedestals are interposed between four nearest second pedestals, and the second pedestals are interposed between four nearest first pedestals.

5. The ventilation panel of claim 1, wherein the insulating foam body further comprises connecting features for connecting to an abutting panel.

6. The ventilation panel of claim 5, wherein the connecting features comprise a tongue formed on a first side surface, and a groove formed on an opposite side surface.

7. The ventilation panel of claim 1, wherein the first face has at least one underfloor heating groove formed therein, the at least one underfloor heating groove being sized to accommodate underfloor heating tubing.

8. The ventilation panel of claim 1, wherein the first face has a plurality of upper pedestals formed therein, the upper pedestals being sized to accommodate underfloor heating tubing therebetween.

9. The ventilation panel of claim 1, wherein the panel comprises a first film of gas-impervious material laminated or adhered to the first face, and a second film of gas-impervious material laminated or adhered to the second face.

10. The ventilation panel of claim 9, wherein the first film and the second film are separate films.

11. The ventilation panel of claim 9, wherein the second film conforms to the walls of the channels and to the bottoms of the grooves.

12. The ventilation panel of claim 1, wherein aligned linear edges defined by the second pedestals are interrupted by the first pedestals, thus reducing the total length of aligned linear edges along the second face.

13. A soil gas barrier system for a building, comprising:

a plurality of soil gas barrier ventilation panels, each ventilation panel comprising:

an insulating foam body having first and second opposing faces and a plurality of grooves to define, in cross-section, a plurality of first pedestals having a first shape and a plurality of second pedestals having a second shape, the first pedestals and the second pedestals each having at least one wall extending from the second face toward the first face defining a plurality of intersecting ventilation channels therebetween, the intersecting ventilation channels defining only three-way intersections; and a film of substantially gas-impervious material laminated or adhered to at least one of the first face and the second face; and a ventilation stack in fluid communication with the ventilation channels of the plurality of ventilation panels, the ventilation stack being configured to convey soil gas to an exterior of the building for discharge.

14. The system of claim 13, wherein the first faces of the ventilation panels define a surface on which a concrete basement floor slab is cast.

15. The system of claim 13, wherein each insulating foam body has side surfaces between the first face and the second face, and wherein the interconnected plurality of ventilation channels are accessible from at least one of the side surfaces.

16. The system of claim 13, wherein the first pedestals are interposed between four nearest second pedestals, and the second pedestals are interposed between four nearest first pedestals.

17. The ventilation panel of claim 13, wherein aligned linear edges defined by the second pedestals are interrupted by the first pedestals, thus reducing the total length of aligned linear edges along the second face.

18. A ventilation panel for a soil gas barrier system, the ventilation panel comprising:

an insulating foam body having first and second opposing faces and a plurality of grooves to define, in cross-section, a plurality of first pedestals having a first shape and a plurality of second pedestals having a second shape, the first pedestals and the second pedestals each having at least one wall extending from the second face toward the first face defining a plurality of intersecting ventilation channels therebetween, the intersecting ventilation channels defining three-way intersections; and a film of substantially gas-impervious material laminated or adhered to at least one of the first face and the second face, wherein the first pedestals are interposed between four nearest second pedestals, and the second pedestals are interposed between four nearest first pedestals, and wherein the second pedestals have a rounded cross-shaped profile with rounded inner corners, and the first pedestals are cylindrical.

19. A ventilation panel for a soil gas barrier system, the ventilation panel comprising:

an insulating foam body having first and second opposing faces and a plurality of grooves to define, in cross-section, a plurality of first pedestals having a first shape and a plurality of second pedestals having a second shape, the first pedestals and the second pedestals each having at least one wall extending from the second face toward the first face defining a plurality of intersecting ventilation channels therebetween, the first pedestals and the second pedestals being arranged such that the ventilation channels are impeded, causing fluid flow to be diverted in different directions; and a film of substantially gas-impervious material laminated or adhered to at least one of the first face and the second face.

20. The ventilation panel of claim 19, wherein aligned linear edges defined by the second pedestals are interrupted by the first pedestals, thus reducing the total length of aligned linear edges along the second face.

* * * * *